US010991315B2

(12) United States Patent
Li et al.

(10) Patent No.: US 10,991,315 B2
(45) Date of Patent: Apr. 27, 2021

(54) DISPLAY PANEL AND DISPLAY DEVICE

(71) Applicant: Shanghai Tianma AM-OLED Co., Ltd., Shanghai (CN)

(72) Inventors: Yue Li, Shanghai (CN); Xingyao Zhou, Shanghai (CN); Kaihong Huang, Shanghai (CN)

(73) Assignee: Shanghai Tianma AM-OLED Co., Ltd., Shanghai (CN)

( * ) Notice: Subject to any disclaimer, the term of this patent is extended or adjusted under 35 U.S.C. 154(b) by 0 days.

(21) Appl. No.: 16/407,050

(22) Filed: May 8, 2019

(65) Prior Publication Data

US 2020/0243021 A1 Jul. 30, 2020

(30) Foreign Application Priority Data

Jan. 25, 2019 (CN) ..... 201910072892.9

(51) Int. Cl.
*G09G 3/3275* (2016.01)
*G09G 3/3266* (2016.01)
*G09G 3/3225* (2016.01)

(52) U.S. Cl.
CPC ..... *G09G 3/3275* (2013.01); *G09G 3/3225* (2013.01); *G09G 3/3266* (2013.01); *G09G 2310/0297* (2013.01)

(58) Field of Classification Search
CPC .. G09G 3/3275; G09G 3/3225; G09G 3/3266; G09G 2310/0297
See application file for complete search history.

(56) References Cited

U.S. PATENT DOCUMENTS

2016/0055789 A1* 2/2016 Hashimoto ..... G09G 3/3648 345/204
2016/0232837 A1* 8/2016 Lee ..... G09G 3/3275
2019/0228726 A1* 7/2019 Ono ..... G09G 3/3648
2020/0066198 A1* 2/2020 Park ..... H01L 27/32

FOREIGN PATENT DOCUMENTS

CN 201815884 U 5/2011
CN 106504696 A 3/2017
CN 206134140 U 4/2017

OTHER PUBLICATIONS

First Office Action, dated Mar. 3, 2020, issued in corresponding Chinese application No. 2019100728929, 11 pages.

* cited by examiner

*Primary Examiner* — Sahlu Okebato
(74) *Attorney, Agent, or Firm* — Christensen O'Connor Johnson Kindness PLLC

(57) ABSTRACT

The present disclosure provides a display panel and display device. The display panel includes: data lines disposed in a display area; a bonding terminal disposed in a non-display area surrounding the display area; fan-out lines; and demuxes disposed between the display area and the bonding terminal; each of the demuxes comprises at least two switch transistors; each switch transistor in one demux has a first electrode electrically connected to a corresponding data line of the data lines through a first connection line, a second electrode connected to the bonding terminal through one of the fan-out lines corresponding to the one demux, and a gate electrode electrically connected to a first clock signal line corresponding to the switch transistor; each fan-out line of the display panel overlaps the first clock signal line for an equal number of times.

17 Claims, 8 Drawing Sheets

DISPLAY PANEL AND DISPLAY DEVICE

CROSS-REFERENCE TO RELATED APPLICATIONS

The present disclosure claims priority to Chinese Patent Application No. 201910072892.9, filed on Jan. 25, 2019, the content of which is incorporated herein by reference in its entirety.

TECHNICAL FIELD

The present disclosure relates to the field of display technologies, and in particular, to a display panel and a display device.

BACKGROUND

At present, the full screen is a development trend of the market, and it is an important technical point to increase the screen occupancy ratio by reducing a width of a step area. In the related art, a demultiplexer (demux) is usually provided to reduce the number of data lines, thereby reducing the width occupied by the data fan-out line, and thus the width of the step area can be reduced. In the related art, after a data signal is written into the data line, the demux is turned off, and the potential of the data signal is maintained by capacitance on the data line. When the data signal is written normally, the data line is in a floating state. However, due to the parasitic capacitance, if the clock signal jumps, the data signal value will be influenced. Moreover, left and right clock signals have different signal aspects and thus different variations, which may result in a phenomenon of split screen.

SUMMARY

In view of this, the present disclosure provides a display panel to solve the above technical problems In an aspect, the present disclosure provides a display panel, including: data lines disposed in a display area; bonding terminals disposed in a non-display area surrounding the display area; fan-out lines; and demuxes disposed between the display area and the bonding terminals, wherein each of the demuxes comprises at least two switch transistors and at least two first clock signal lines; and each switch transistor in one demux of the demuxes has a first electrode electrically connected to a corresponding data line of the data lines through a first connection line, a second electrode connected to one of the bonding terminals through one of the fan-out lines corresponding to the one demux, and a gate electrode electrically connected to one of the at least two first clock signal lines corresponding to the switch transistor; wherein each of the fan-out lines of the display panel overlaps each of the at least two first clock signal lines for an equal number of times.

In another aspect, the present disclosure provides a display device including the display panel described above.

BRIEF DESCRIPTION OF DRAWINGS

In order to more clearly illustrate technical solutions in embodiments of the present disclosure, the accompanying drawings used in the embodiments are briefly introduced as follows. It should be noted that the drawings described below are merely part of the embodiments of the present disclosure and other drawings can also be acquired by those skilled in the art without paying creative efforts based on these drawings.

DESCRIPTION OF EMBODIMENTS

For better illustrating technical solutions of the present disclosure, embodiments of the present disclosure will be described in detail as follows with reference to the accompanying drawings.

It should be noted that, the described embodiments are merely exemplary embodiments of the present disclosure but not all of the embodiments. All other embodiments obtained by those skilled in the art without creative efforts according to the embodiments of the present disclosure are within the scope of the present disclosure.

The terms used in the embodiments of the present disclosure are merely for the purpose of describing particular embodiments but not intended to limit the present disclosure. Unless otherwise noted in the context, the singular form expressions "a", "an", "the" and "said" used in the embodiments and appended claims of the present disclosure are also intended to represent plural form expressions thereof.

It should be understood that the term "and/or" used herein is merely an association relationship describing associated objects, indicating that there may be three relationships, for example, A and/or B may indicate that three cases, i.e., only A exists, both A and B exists, and only B exists. In addition, the character "/" herein generally indicates that the related objects before and after the character form an "or" relationship.

It should be understood that, although the clock signal may be described using the terms of "first", "second", "third", etc., in the embodiments of the present disclosure, the clock signal will not be limited to these terms. These terms are merely used to distinguish clock signals from one another. For example, without departing from the scope of the embodiments of the present disclosure, a first clock signal may also be referred to as a second clock signal, similarly, a second clock signal may also be referred to as a first clock signal.

As described in the background, the demux is turned off and the potential is maintained by the capacitance on the data line. When the data signal is written normally, the data line is in a floating state. However, due to the parasitic capacitance, if the clock signal jumps, the data signal value will be influenced. Moreover, left and right clock signals have different states and thus different variations, which may result in a phenomenon of split screen.

An embodiment of the present disclosure provides a display panel which can avoid the phenomenon of split screen without needing to completely avoid overlapping between the data line and the clock signal, while avoiding the difference between the signal aspects of the left and right clock signals.

Figure 1:
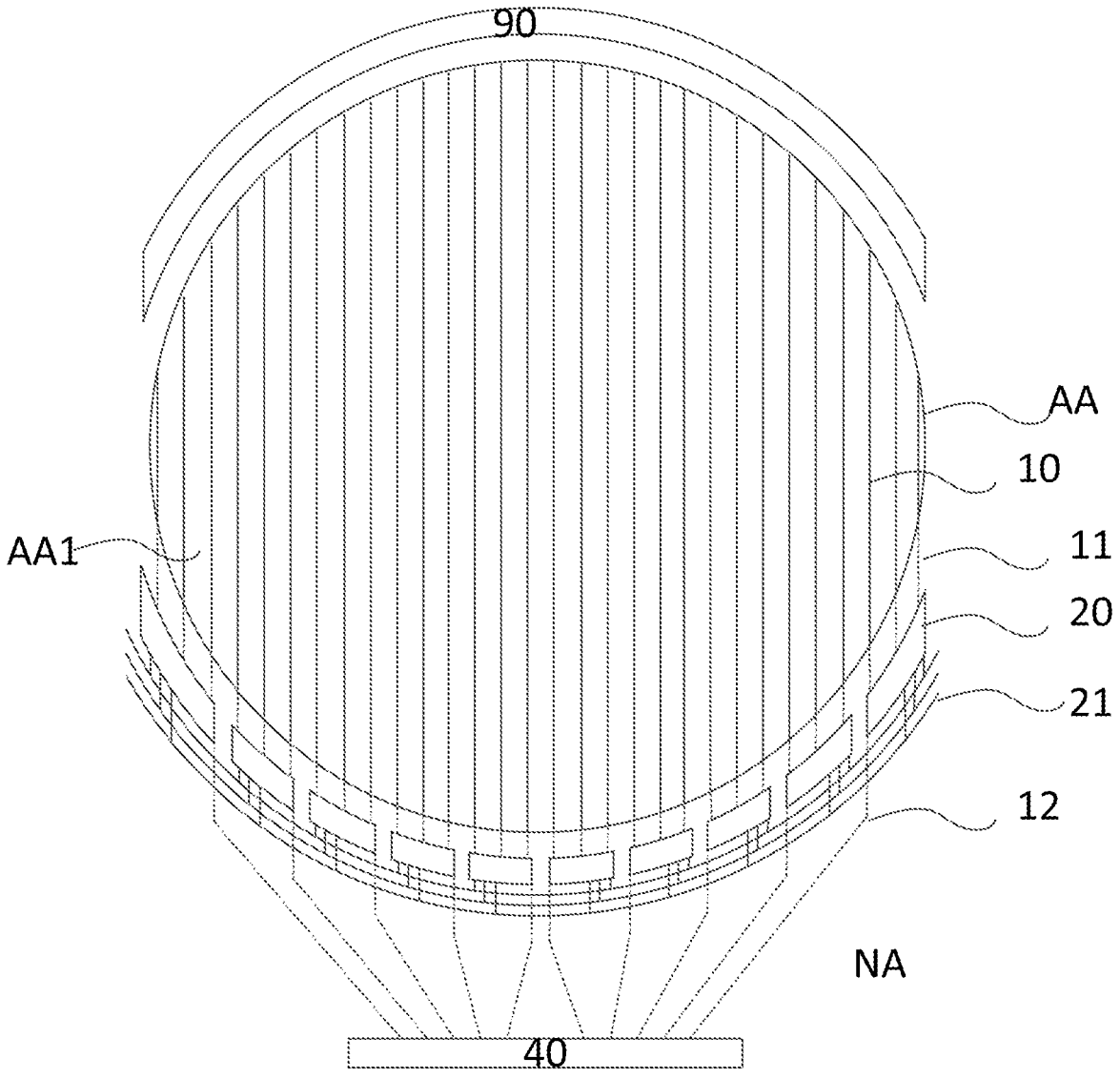
FIG. 1 is a schematic diagram of a display panel according to an embodiment of the present disclosure.
Figure 2:
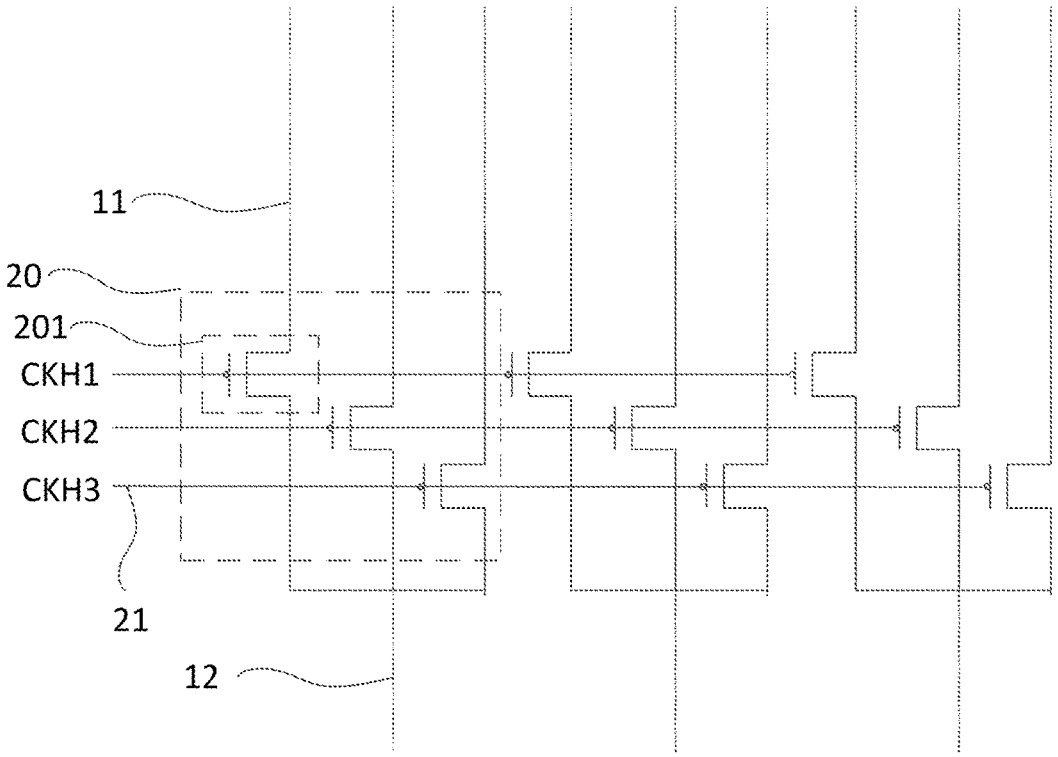
FIG. 2 is a schematic diagram of an equivalent circuit of a demux of a display panel according to an embodiment of the present disclosure.

FIG. 1 is a schematic diagram of a display panel according to an embodiment of the present disclosure; FIG. 2 is a diagram of an equivalent circuit of a demux of a display panel according to an embodiment of the present disclosure; and FIG. 3 is a sequence diagram of the equivalent circuit of FIG. 2.

Figure 3:
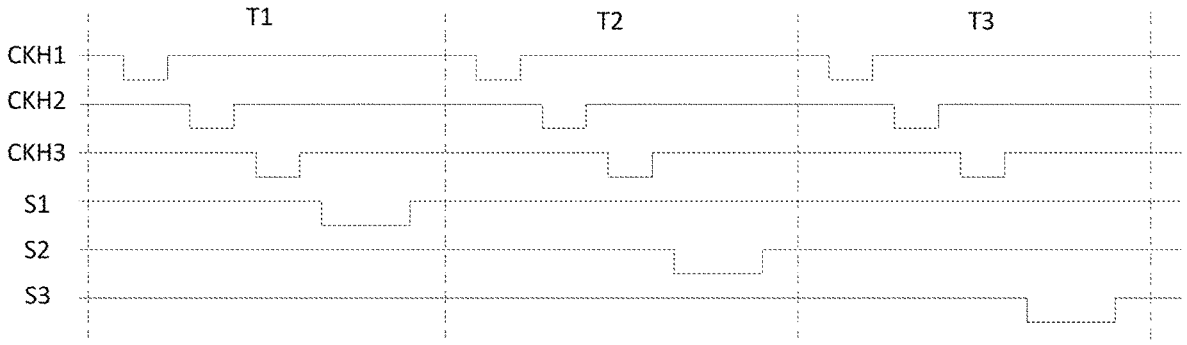
FIG. 3 is a sequence diagram of the equivalent circuit of FIG. 2.

With reference to FIGS. 1-3, the display panel of the present disclosure has a display area AA and a non-display display area NA surrounding the display area AA. The display panel includes data lines 10 disposed in the display area AA; a bonding terminal 40 disposed in the non-display area NA; fan-out lines 12; and demuxes 20 disposed between the display area AA and the bonding terminal 40. Each demux 20 includes at least two switch transistors 201 and at least two first clock signal lines 21. Each switch transistor 201 in one demux 20 has a first electrode electrically connected to a corresponding data line 10 via a respective first connection line 11, a second electrode connected to the bonding terminal 40 via one of the fan-out lines 12 corresponding to the demux 20, and a gate electrode electrically connected to one of the at least two first clock signal lines 21 corresponding to the switch transistor.

The function and working process of the demux 20 will be described below with reference to FIG. 2 and FIG. 3. Take a 1:3 demux as an example, where 1:3 indicates that one fan-out line 12 is connected to three data lines 10 via three connection lines 11 through the demux circuit, and sends a data signal to the three data lines in a time division manner. There are three first clock signals 21 in a 1:3 demux circuit, the gate electrodes of the switch transistors electrically connected to $(3m-2)^{th}$ data lines are electrically connected to the same first clock signal; the gate electrodes of the switch transistors electrically connected to $(3m-1)^{th}$ data lines are electrically connected to the same first clock signal; and the gate electrodes of the switch transistors electrically connected to $(3m)^{th}$ data lines are electrically connected to the same first clock signal. Herein, m is an integer greater than or equal to 1. In this way, the entire demux 20 requires only three first clock signal. In an example, as shown in FIG. 2, the switch transistors connected to the $1^{st}$, $4^{th}$ and $7^{th}$ data lines correspond to a first clock signal CKH1; the switch transistors connected to the $2^{nd}$, $5^{th}$ and $8^{th}$ data lines correspond to a first clock signal CKH2; and the switch transistors connected to the $3^{rd}$, $6^{th}$ and $9^{th}$ data lines correspond to a first clock signal CKH3. With reference to the sequence diagram of FIG. 3, taking a PMOS transistor as an example, the transistor is turned on when the first clock signal is at a low level. Here, T1, T2, and T3 periods respectively represent time periods in which data is written into pixels in a $1^{st}$ row, in a $2^{nd}$ row, and in a $3^{rd}$ row. In the T1 period, when the first clock signal CKH1 is at a low level, both CKH2 and CKH3 are at a high level. In this case, the switch transistor connected to CKH1 is turned on, and then the data signal is transmitted, through the fan-out line 12, to the connection line 11 corresponding to the switch transistor connected to CKH1, and then input into a corresponding data line through the connection line 11. Similarly, when the first clock signal CKH2 is at a low level, both CKH1 and CKH3 are at a high level. In this case, the switch transistor connected to the CKH2 is turned on, and then the data signal is transmitted, through the fan-out line 12, to the connection line 11 corresponding to the switch transistor connected to CKH2, and then input into a corresponding data line through the connection line 11. Similarly, when the first clock signal CKH3 is at a low level, both CKH2 and CKH1 are at a high level. In this case, the switch transistor connected to CKH3 is turned on, and then the data signal is transmitted, through the fan-out line 12, to the connection line 11 corresponding to the switch transistor connected to CKH3, and then input into a corresponding data line through the connection line 11. Therefore, an area occupied by the data line fan-out area can be reduced by merely effectively reducing the quantity of lines connected between the data lines and the bonding terminal 40, and thus a width occupied by the step area can be effectively reduced, thereby achieving a narrow step area.

Figure 12:
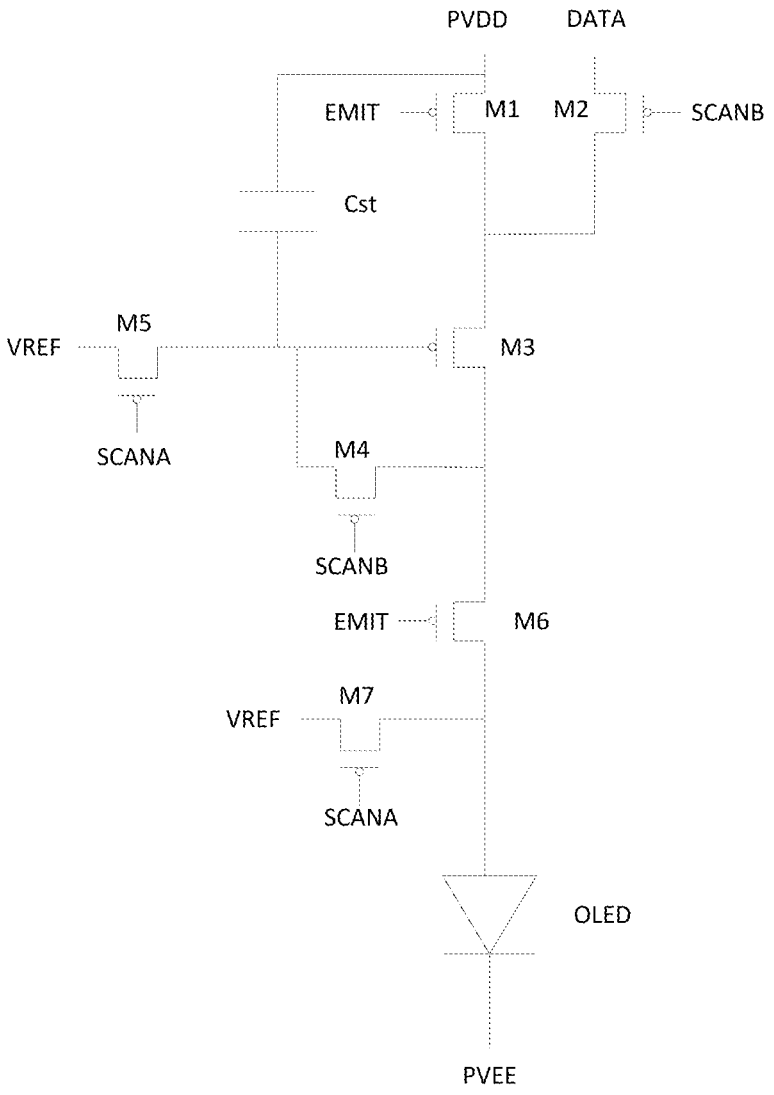
FIG. 12 is a schematic diagram of a driving circuit of a display panel according to an embodiment of the present disclosure.
Figure 13:
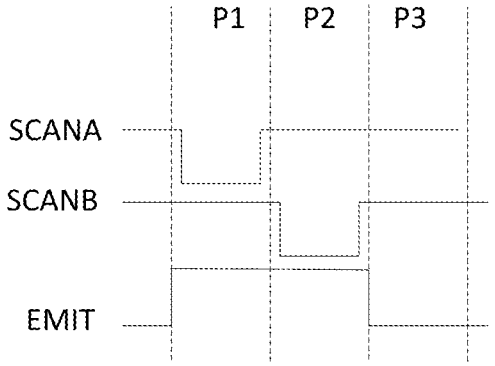
FIG. 13 is a sequence diagram of the driving circuit of FIG. 12.

Further, the data signal is supplied to the pixel circuit in order to generate a driving current for driving the organic light-emitting device to emit light. FIG. 12 is a schematic diagram of a driving circuit of a display panel according to an embodiment of the present disclosure; and FIG. 13 is a sequence diagram of the driving circuit of FIG. 12. In some embodiments, with reference to FIG. 12 and FIG. 13, each pixel row includes pixel driving circuits, and each pixel driving circuit includes: a driving transistor M3, connected in series between a light-emitting control transistor M1 and a light-emitting device OLED, and configured to generate a driving current; an initialization transistor M5, connected in series between an initialization signal line VREF and a gate electrode of the driving transistor M3, and configured to initialize the driving transistor M3 in response to a first scan driving signal SCANA; a compensation transistor M4, connected in series between the gate electrode of the driving transistor M3 and a drain electrode of the driving transistor M3, and configured to perform threshold compensation to the driving transistor M3 in response to a second scan driving signal SCANB; a light-emitting control transistor M1, connected in series between a power signal line PVDD and the driving transistor M3, and configured to transmit a power signal to a source electrode of the driving transistor M3 in response to a light-emitting control signal EMIT.

In addition, in some embodiments, the pixel driving circuit further includes a sixth transistor M6, connected in series between the third transistor M3 and the light-emitting device OLED, and configured to control whether the driving current flows through the light-emitting device OLED in response to a light-emitting control signal EMIT.

In an embodiment, the pixel driving circuit further includes an initialization transistor M7, configured to initialize the light-emitting device OLED in response to the first scan driving signal SCANA.

The working process of the pixel driving circuit of the present disclosure will be described below with reference to the sequence diagram of FIG. 13.

In a first period P1, the first scan driving signal SCANA is at a low level, the second scan driving signal SCANB is at a high level, and the light-emitting control signal EMIT is at a high level. At this time, the transistors M5 and M7 are turned on and other transistors are turned off. An initialization signal VREF is transmitted to the gate electrode of the driving transistor M3 to initialize the driving transistor. The initialization signal VREF is transmitted to the light-emitting device OLED through the transistor M7 to initialize the light-emitting device.

In a second period P2, the first scan driving signal SCANA is at a high level, the second scan driving signal SCANB is at a low level, and the light-emitting control signal EMIT is at a high level. At this time, the data signal DATA is transmitted to the source electrode of the driving transistor M3 through the transistor M2. Since the initialization signal of the previous period is a low-level, then in the second period P2, the driving transistor M3 is turned on, and the data signal DATA is transmitted to the gate electrode of the driving transistor M3 through the compensation transistor M4, so that a potential of the gate electrode of the driving transistor M3 is raised. When the potential of the driving transistor M3 reaches Vdata-Vth, the driving transistor is turned off, and the potential of the gate electrode is stored by a storage capacitor Cst.

In a third period P3, the first scan driving signal SCANA is at a high level, the second scan driving signal SCANB is at a high level, and the light-emitting control signal EMIT is at a low level. The light-emitting control transistor M1 is turned on and the power voltage PVDD is transmitted to the source electrode of the driving transistor M3. At this time, a voltage of the gate electrode of the driving transistor M3 is Vdata−Vth, and therefore, the driving current $Ids=k*(Vgs-Vth)^2=k*(PVDD-(Vdata-Vth)-Vth)^2=k*(PVDD-Vth)^2$. In this way, the influence of a drift of the threshold voltage Vth on the light-emitting driving current is eliminated, that is, the drift of the threshold voltage is compensated.

When the data signal is written to the data line 10, it is stored by the capacitance of the data line. However, when the fan-out line overlaps the first clock signal line 20, the jump of the first clock signal is coupled to the data line 10 by a parasitic capacitance between the two, such that the data signal written to the data line 10 changes. When the clock signals of adjacent data lines have different signal aspects, it will cause differences in the data signals, which then results in the phenomenon of split screen. In order to avoid the split screen, each fan-out line 12 of the display panel of the present disclosure overlaps each first clock signal line 21 for the same number of times. That is, the connection line of each data line of the display panel overlaps the first clock signal lines in the same manner, and the clock signals of the data signal lines of the display panel have the same signal aspect, thereby avoiding the split screen.

With further reference to FIG. 1, in an embodiment, the display area AA includes a first display area AA1. Rows of pixels are disposed in the first display area AA1. The number of pixels in each row in the first display area AA1 is reduced along a direction toward the bonding terminal 40. For a conventional rectangular display panel, the fan-out line of the data line is disposed in a lower step area of the display panel, whereas in this embodiment, the display panel does not have a specific lower step area. For example, for the circular display panel shown in FIG. 1, the position of the lower semicircular portion of the display panel also belongs to left and right borders. The layout in the related art is prone to a case where the overlapping times between the fan-out line 12 and the first clock signal line 21 are different for different fan-out lines 12. In this embodiment of the present disclosure, the fan-out lines 12 overlaps the first clock signal lines 21 in the same manner, thereby avoiding the phenomenon of split screen. In order to compensate length differences of the data lines, in an embodiment, a compensation capacitor 90 is provided to compensate a load difference of the data lines caused by different number of sub-pixels connected there to.

Figure 4:
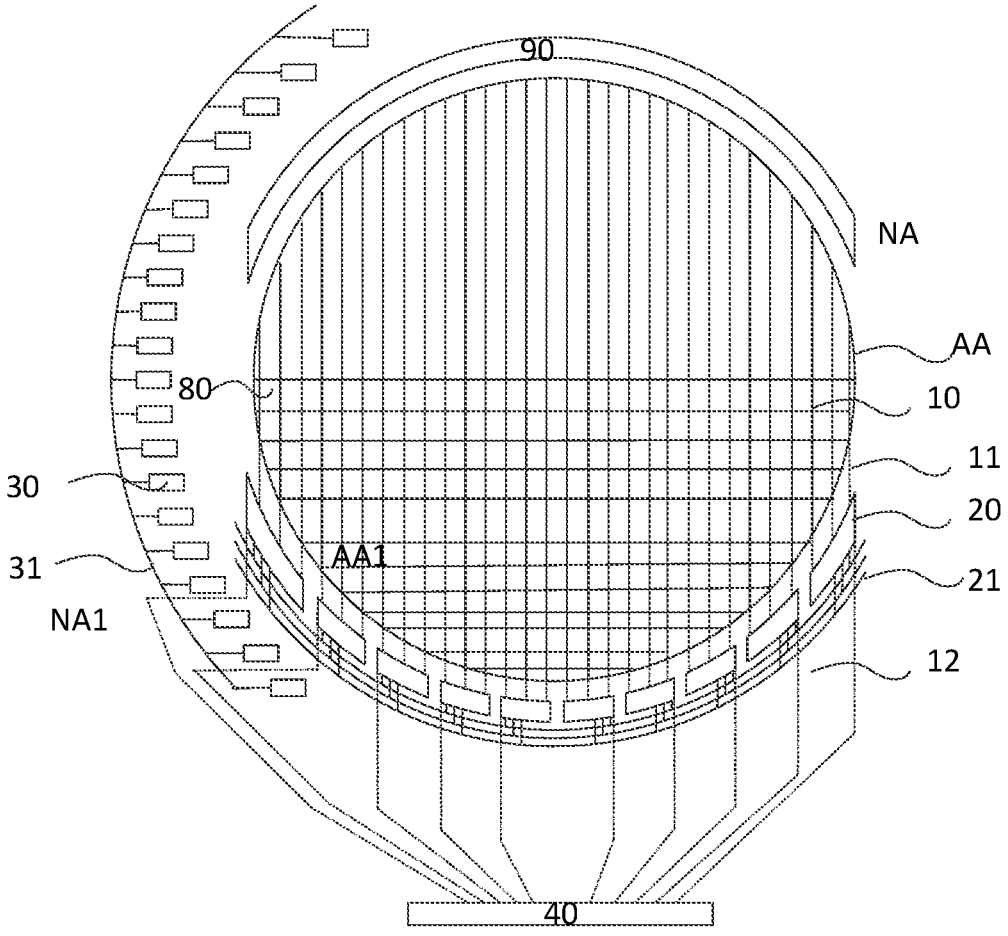
FIG. 4 is a schematic diagram of a display panel according to another embodiment of the present disclosure.

FIG. 4 is a schematic diagram of a display panel according to another embodiment of the present disclosure. Further, with reference to FIG. 4, the non-display area includes a first non-display area NA1 surrounding the first display area AA1.

The display panel is provided with a scan driving circuit 30 disposed in the first non-display area NA1. The scan driving circuit 30 includes a second clock signal line 31. The demuxes 20 are disposed between the scan driving circuit 30 and the display area AA. The first connection lines 11 do not overlap the second clock signal line 31.

Please refer to FIG. 2, FIG. 3, FIG. 12 and FIG. 13. As shown in FIG. 3, in an embodiment of the present disclosure, the display panel further includes a scan signal that writes the data signal to the pixel driving circuit. In one cycle, an effective level of the scan signal is after an effective level of the first clock signal. It should be noted that the effective level refers to a level that can enable a transistor connected thereto to get into a working state. With reference to the sequence diagram shown in FIG. 3, after CKH1, CKH2, and CKH3 sequentially input an effective level, the data signal is sequentially input to the data lines 10 connected to the connection lines 11 through the fan-out line 12, and the capacitance of the data lines 10 stores the data signal. With reference to FIG. 12 and FIG. 13, when the scan signal SCANB is at a low level, the data signal is written to the gate electrode of the driving transistor M3. In FIG. 3, S1 corresponds to the SCANB of the pixel circuits of the first row. Similarly, S2 and S3 correspond to the SCANB of the pixel circuits of the second row and the SCANB of the pixel circuits of the third row, respectively. Therefore, when S1 is at a low level, the corresponding data lines 10 simultaneously write a data signal to the gate electrode of the driving transistor. At this time, CKH1, CKH2, and CKH3 are all at a high level, and the signal fluctuation in the fan-out line 12 has no influence on writing of the data signal to the gate electrode of the driving transistor. Therefore, in this embodiment, the risk that the data signal is influenced by the clock signal is reduced, so that the display panel provided by the present disclosure has a stable display.

Further, as shown in FIG. 4, in the illustrated display panel both the scan driving circuit 30 and the demux 20 need to be disposed in the peripheral area. In this embodiment, the demux 20 is disposed between the scan driving circuit 30 and the display area AA, so that the situation that the connection lines overlap the second clock signal line 31, which may affect the data signal stored in the data lines 10, is avoided. If the scan driving circuit 30 is disposed between the demux 20 and the display area AA, the connection line 11 must overlap the second clock signal line 31 of the scan driving circuit 30. At this time, even if the first clock signals CKH1-CKH3 are at a high level, the connection lines 11 remains electrically connected to the data lines 10. As a result, the second clock signal line 31 overlaps the connection lines 11. Thus, when the second clock signal jumps between a high level and a low level, the jumping signal is coupled to the connection line 11 and the data line 10, thereby affecting the data signal stored in the data line 10. As a result, the actual displaying brightness of the image does not conform to the target brightness. In this embodiment, the second clock signal line 31 merely overlaps the fan-out lines 12, and when S1 is at a low level, and CKH1-CKH3 are at a high level, the switch transistors 201 are turned off, and the fan-out lines 12 are electrically disconnected from the data lines 10. Therefore, even if the second clock signal jumps between a high level and a low level, the signal will not be coupled to the data line 10 that stores the data signal, so that the aforementioned problem can be avoided.

Figure 5:
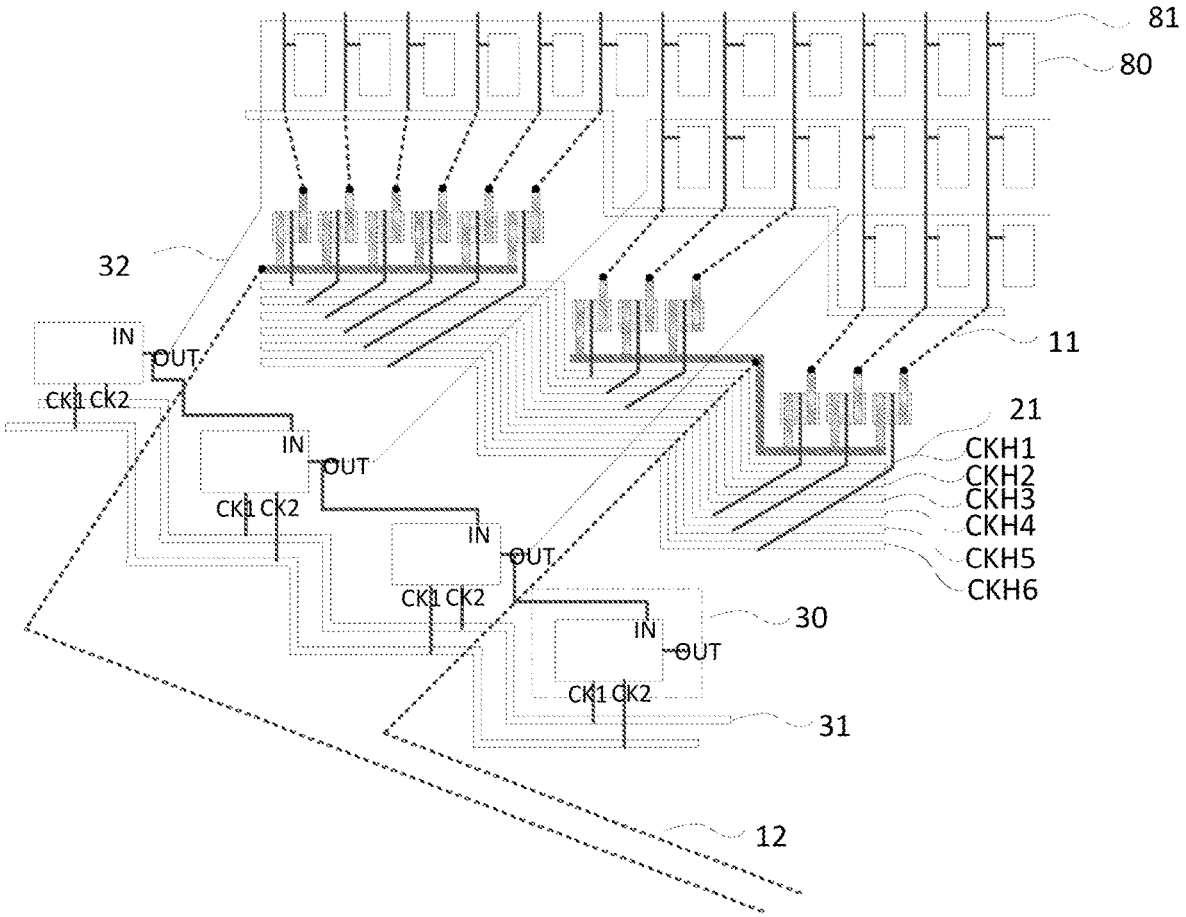
FIG. 5 is an enlarged view of a left lower portion of the display panel of FIG. 4.
Figure 6:
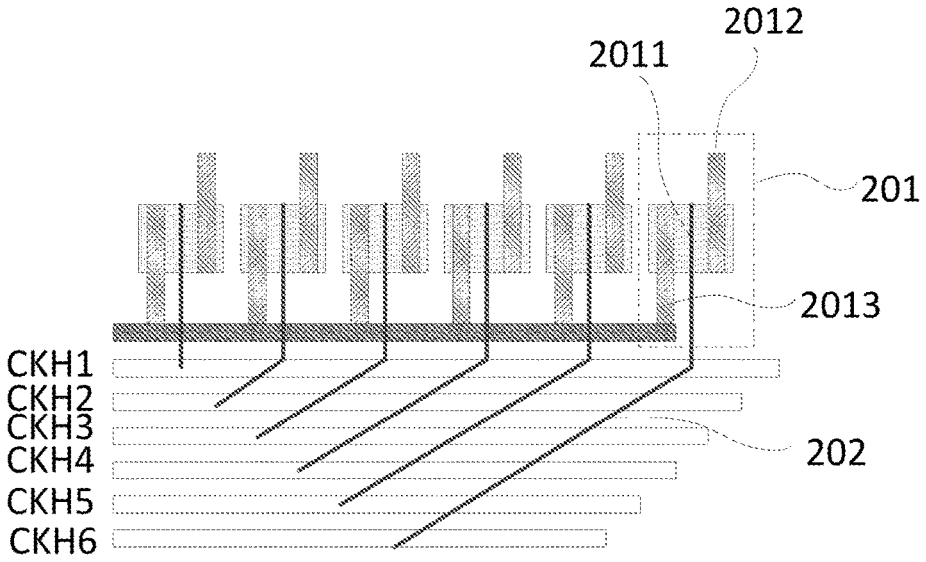
FIG. 6 is a partially enlarged view of the demux of FIG. 5.

Further, please refer to FIG. 5 and FIG. 6. FIG. 5 is an enlarged view of a left lower portion of the display panel of the FIG. 4. FIG. 6 is a partially enlarged view of the demux of FIG. 5.

As shown in FIG. 6, in the same demux, each switch transistor includes a gate electrode 2011, the gate electrode 2011 of each switch transistor is connected to a respective first clock signal line, and the first electrode 2012 of each switch transistor is connected to a respective connection line 11. The second electrodes of the switch transistors in one demux are connected together and connected to the same fan-out line 12. Further, each demux is connected to the first clock signal lines through corresponding fourth connection lines 202. The fourth connection lines 202 corresponding to each demux constitute an isosceles triangle. This allows a relatively uniform space respectively reserved at a left side and a right side of each connection line, and also a relatively uniform space reserved between adjacent demuxes which is advantageous to arrangement of other signal lines or devices. Moreover, when other signal line such as the fan-out line is arranged between adjacent demuxes, these fan-out lines can have an almost equal distance to their respective adjacent demuxes, which is advantageous for uniformity of the display panel.

The connection lines 11 remain electrically connected to the data lines 10 regardless of whether or not the switch transistors 201 of the demux 20 are turned off. Therefore, when the first clock signal lines 21 overlap the connection lines 11, jump of the first clock signal will affect the signal stored in the data lines. In view of this, it should be avoided that the first clock signal lines 21 overlap the connection lines 11. In an embodiment of the present disclosure, the first clock signal lines 21 are disposed on a side of the demuxes 20 facing away from the display area AA, and the connection lines 11 are disposed between the demuxes 20 and the display area AA. Therefore, in this embodiment, the first clock signal lines 21 overlap the fan-out lines 12, but the first clock signal lines 21 do not overlap the connection lines 11. In this way, changing of the first clock signal does not influence the signal in the data line.

With further reference to FIG. 5, each demux includes n switch transistors and n different first clock signal lines. In one demux, the corresponding fan-out line overlaps each first clock signal line for an equal number of times. The n first clock signals sequentially output an effective signal, which enables a data signal to be sequentially output from the fan-out line to the corresponding data lines. When only a part of the first clock signal lines overlaps the fan-out line, only a part of the data lines is affected by jump of the first clock signal while other data lines are not affected, which then results in the phenomenon of split screen. For example, with reference to FIG. 5 and FIG. 6, the demux includes six switch transistors and six different first clock signal lines CKH1, CKH2, CKH3, CKH4, CKH5, and CKH6. When CKH1 is at an effective level, the fan-out line 12 is connected to a first data line and provides a data signal to the first data line; when CKH2 is at an effective level, the fan-out line 12 is connected to a second data line and provides a data signal to the second data line; . . . ; when the CKH6 is at an effective level, the fan-out line 12 is connected to a sixth data line and provides a data signal to the sixth data line. When only CKH1 and CKH2 overlap the fan-out line 12 while CKH6 does not overlap the fan-out line 12, the signal transmitted from the fan-out line 12 to the first or second data line will be coupled once by the first clock signal, while the signal transmitted to the sixth data line will not be coupled to the first clock signal. As a result, the data signals that are transmitted are different, resulting in the split screen. Similarly, when both CKH1 and CKH2 overlap the fan-out line 12 for two times while CKH6 overlaps the fan-out line 12 for only one time, the signal transmitted from the fan-out line 12 to the first data line or the second data line will be coupled by the first clock signal for two times, while the signal transmitted to the sixth data line will be coupled by the first clock signal for only one time. Similarly, the data signals that are transmitted are different, resulting in the split screen. In this embodiment, in order to avoid the phenomenon of split screen caused by different coupling times, the fan-out line overlaps each first clock signal line for an equal number of times for the same demux.

In a further embodiment, the demux 20 includes six switch transistors 201 and six first clock signal lines 21. The fan-out line 12 overlaps each first clock signal line 1 for one time, or the fan-out line 12 overlaps each first clock signal line 1 for two times. In this case, one the one hand, the fan-out line overlaps each first clock signal line 21 for an equal number of times, and on the other hand, the number of overlapping times is relatively small, the coupling amount is small, and displaying brightness is more accurate.

In addition, the first clock signal has turned off all the transistors 201 corresponding to the demux 20 when the second clock signal jumps, and at this time, the fan-out line 12 is disconnected from the data lines 10. Therefore, in theory, overlapping between the second clock signal line 31 and the fan-out line does not affect the signal stored in the data lines 10. However, at this time, the fan-out line 12 still has parasitic capacitance, and when the fan-out lines 12 overlap the second clock signal line for different times, the potential in the fan-out line 12 will be different due to the coupling change, then in a next moment, the data signal will change when it is transmitted to other data line through the fan-out line 12, resulting in the split screen. In view of this, in the embodiment of the present disclosure, the second clock signal of the scan driving circuit 30 is coupled to the fan-out line 12, and the fan-out line 12 also has parasitic capacitance with other signal line of the display panel. The fan-out lines 12 overlap the second clock signal line 31, and each fan-out line 12 overlaps the second clock signal line 31 for an equal number of times. Therefore, the split screen can be avoided.

Further, the display area AA is further provided with scan lines 81 intersecting with the data lines 10. The scan lines 81 intersect with the data lines 10 to define pixel driving circuits 80. As shown in FIG. 5, in an embodiment, the scan driving circuit 30 is controlled by two second clock signals CK1, CK2 and one input signal IN to output a scan driving signal from an output line OUT. The scan driving circuit 30 further includes an output signal line 32, and the output signal line 32 is connected to the scan line 81 disposed in the display area. None of the fan-out lines 12 of the display panel overlaps with the output signal line 32. For the same reason as described above, when the output signal of the output signal line 32 jumps, it is coupled to the fan-out line 12 through a parasitic capacitance, which then affects the data signal in the next moment. In view of this, in the embodiment of the present disclosure, the output signal line 32 does not overlap the fan-out line 12, so that the above problem can be avoided.

Further, the output signal line 32 overlaps the data line 10, and the output signal line 32 does not overlap the first connection line 11. The connection line 11 of the display panel is generally wider than the data line 10. In a direction perpendicular to the display panel, a distance between the connection line 11 and the output signal line 32 is smaller than a distance between the data line 10 and the output signal line 32. The capacitance is proportional to an effective overlapping area but is inversely proportional to the distance. Therefore, the parasitic capacitance in a case where the connection line 11 overlaps the output signal line 32 is greater than the parasitic capacitance in a case where the data line 10 overlaps the output signal line 32. In view of this, in the embodiment of the present disclosure, the output signal line 32 overlaps the data line 10, thereby providing a smaller parasitic capacitance, and thus minimizing the influence of the output signal of the scan driving circuit 30 on the data signal.

Figure 7:
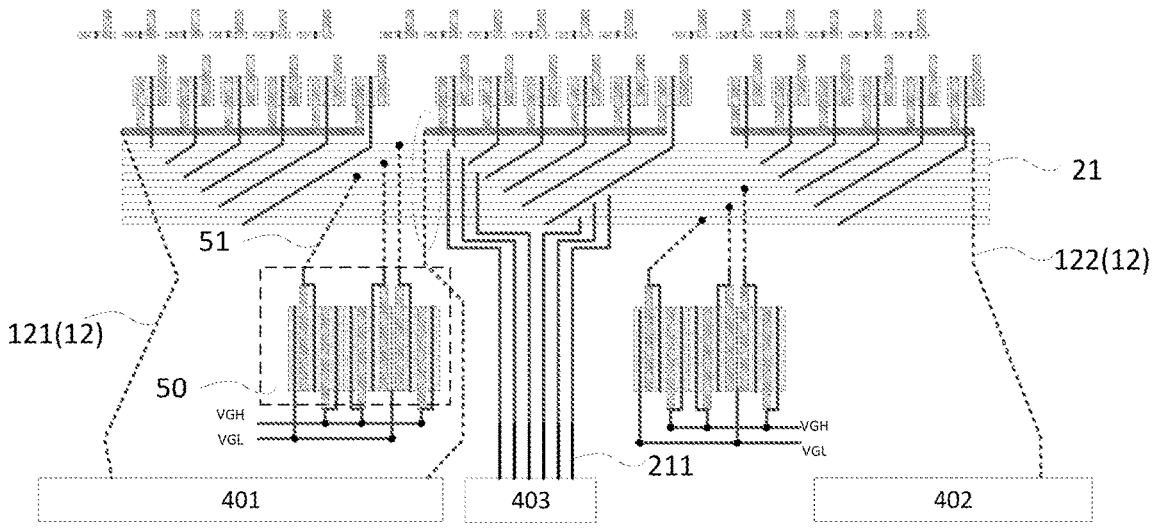
FIG. 7 is a partially enlarged view showing a lower portion of the display panel of FIG. 4.

Please refer to FIG. 7 for another embodiment of the present disclosure. FIG. 7 is a partially enlarged view of a lower portion of the display panel of FIG. 4. In this embodiment, the display panel includes a first clock signal line bonding terminal 403. The bonding terminal 40 includes a first bonding terminal 401 and a second bonding terminal 402. The first clock signal line bonding terminal 403 is disposed between the first bonding terminal 401 and the second bonding terminal 402. The fan-out lines 12 include a first fan-out line 121 and a second fan-out line 122. The first fan-out line 121 is connected to the first bonding terminal 401, and the second fan-out line 122 is connected to the second bonding terminal 402. The first clock signal lines 21 are connected to the first clock signal line bonding terminal 403 through second connection lines 211. The second connection lines 211 are disposed between the first fan-out line 121 and the second fan-out line 122. The second connection lines 211 do not overlap the first fan-out line 121 or the second fan-out line 122. Since the first clock signal lines receive signals from the driving chip, it is necessary to provide the first clock signal line bonding terminal, and the first clock signal lines need to provide the first clock signal to all the demuxes 20. In this embodiment, the fan-out lines 12 include a first fan-out line 121 and a second fan-out line 122, and the first fan-out line 121 is separated from the second fan-out line 122 from the middle of the display panel. The quantity of the first fan-out line 121 is substantially equal to the quantity of the second fan-out line 122. The first clock signal line bonding terminal 403 is disposed between the first fan-out line 121 and the second fan-out line 122, so that the signal can be transmitted from the middle position of the panel. The distances from the first clock signal line to both sides of the display panel are substantially equal, so that consistency of the first clock signal can be achieved. Besides, in this embodiment, the second connection lines 211 do not overlap the first fan-out line 121 and do not overlap the second fan-out line 122. If the second connection lines 211 overlap the first fan-out line 121 or the second fan-out line 122, at least one fan-out line would overlap each first clock signal line for two times, in this case, based on the solution of the present disclosure, each fan-out line would overlap twice. In this case, there would be a large number of overlapping times, a large area would be occupied, the parasitic capacitance would be large, and the displaying brightness would be inaccurate. In view of this, in the embodiment of the present disclosure, the second connection lines 211 do not overlap the fan-out lines 12, thereby avoiding the above problems.

Further, a connection point where the first fan-out line 121 is connected to the demux is disposed at a side of the demux facing away from the second fan-out line 122, a connection point where the second fan-out line 122 is connected to the demux is disposed at a side of the demux facing away from the first fan-out line 11. In this case, a spacing reserved between adjacent first fan-out line 121 and second fan-out line 122 can be twice the spacing between two adjacent first fan-out lines 121 (or two adjacent second fan-out lines 122), and the reserved space can be used for arrangement of the second connection lines 211, avoiding overlapping between the fan-out lines and the second connection lines.

Further, first electrostatic discharge circuits 50 are further included. The first electrostatic discharge circuits 50 are connected to the first clock signal lines 21 through third connection lines 51, and are configured to discharge static electricity of the first clock signal lines 21. The first electrostatic discharge circuits 50 are disposed between the first fan-out line 121 and the second fan-out line 122. As described above, the distance between the first fan-out line 121 and the second fan-out line 122 is relatively large, and thus there is enough space for disposing the electrostatic discharge circuits 50. It should be noted that, it is not limited in the embodiment of the present disclosure that each electrostatic discharge circuit is disposed between adjacent first fan-out line 121 and second fan-out line 122. If the spacing between the first fan-out line 121 and the second fan-out line 122 is not enough for disposing all the electrostatic discharge circuits, a part of the electrostatic discharge circuits can be disposed at other position, for example, a position between adjacent first fan-out lines 121. In the embodiment of the present disclosure, the electrostatic discharge circuits 50 are configured to discharge the static electricity of the first clock signal lines 21, and are placed in a position with a relatively large spacing in order to avoid overlapping with the fan-out lines 12.

Further, the third connecting lines 51 do not overlap the fan-out lines 12. If the third connection lines 51 overlap the first fan-out line 121 or the second fan-out line 122, at least one fan-out line would overlap each first clock signal line twice, and then based on the solution of the present disclosure, each fan-out line would overlap two times. In this case, there would be many overlapping times, the area occupied would be large, the parasitic capacitance would be large, and the displaying brightness may be inaccurate. In view of this, in the embodiment of the present disclosure, the third connection lines 51 do not overlap the fan-out lines 12, thereby avoiding the above problems.

Figure 8:
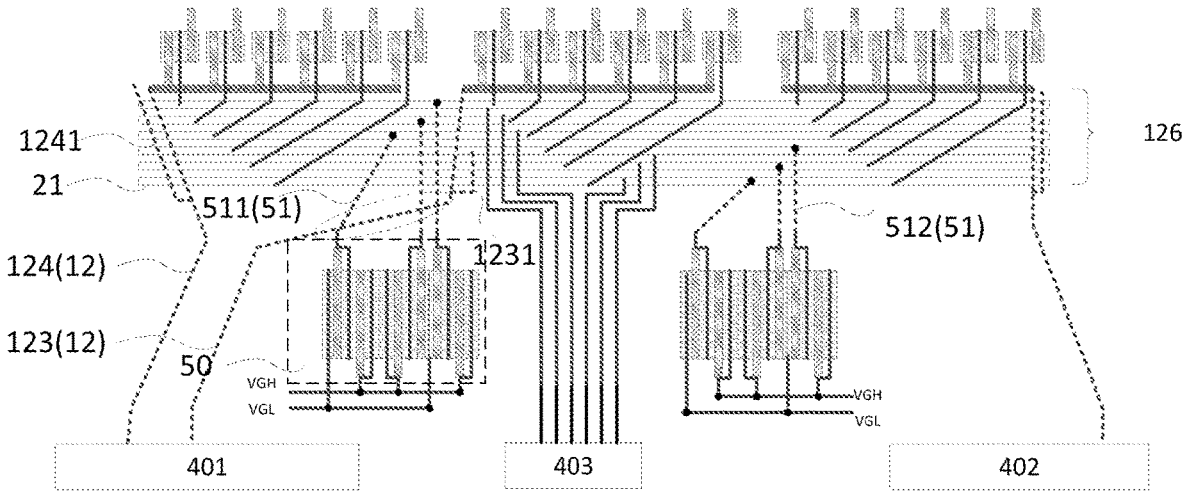
FIG. 8 is another partially enlarged view showing a lower portion of the display panel of FIG. 4.

Please refer to FIG. 8 for still another embodiment of the present disclosure. FIG. 8 is another partially enlarged view of a lower portion of the display panel of FIG. 4. Considering the actual layout of the display panel is complicated and the space is compact, the fan-out line may overlap the first clock signal line. Therefore, in this embodiment, the fan-out lines include at least one third fan-out line 123 that each overlaps one of the third connection lines 51 for one time and a fourth fan-out line 124 that does not overlap the third connection lines 51. In this case, in the display panel, at least one third fan-out line 123 overlaps the first clock signal lines in a different manner. Further, the fourth fan-out line 124 includes a first overlapping section 1241 that overlaps each first clock signal line 21 for one time. In this way, each fan-out line 12 overlaps the first clock signal lines 21 in the same manner. It should be noted that in this embodiment, when the fan-out line 12 overlaps the first clock signal line 21, it means that the fan-out line 12 overlaps a line having the first clock signal, for example, the third connection line 51 also belongs to the first clock signal line. In this embodiment, when one or more fan-out lines 12 overlap the third connection line, the remaining fan-out lines each have the first overlapping section 1241, so that the remaining fan-out lines each overlap the first clock signal lines in the same manner.

Further, the third connection lines 51 are disposed in a different metal layer from the first clock signal lines 12 of the demuxes. In the embodiment of the present disclosure, the first overlapping section 1241 and the fourth fan-out line 124 may be disposed in different metal layers, and in the direction perpendicular to the display panel, a distance between the first overlapping section 1241 and the fourth fan-out line is substantially equal to a distance between the third connecting line 51 and the third fan-out line 123.

Further, the third connection lines 51 includes a first type of third connection line 511 and a second type of third connection line 512. The third fan-out line 123 overlaps the first type of third connection line 511 but does not overlap the second type of third connection line 512. The third fan-out line 123 further includes a second overlapping section 1231 that overlaps the first clock signal line corresponding to the second type of third connection line 512 for one time. As described above, if the first clock signal line corresponding to the first type of third connection line overlaps the third fan-out line for two times and the first clock signal line corresponding to the second type of third connection line overlaps the third fan-out line for one time, it results in different coupling situations, which then leads to differences in transmitted data signals, and thus the phenomenon of split screen. In view of this, in this embodiment, the second overlapping section 1231 is disposed such that the third fan-out line 123 overlaps each first clock signal line for an equal number of times, thereby avoiding the split screen.

Figure 9:
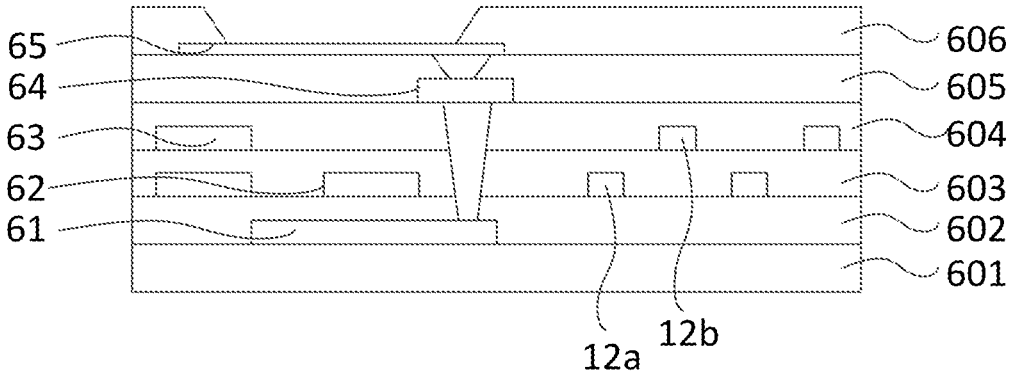
FIG. 9 is a schematic cross-sectional diagram of a display panel according to an embodiment of the present disclosure.

FIG. 9 is a schematic cross-sectional diagram of a display panel according to still another embodiment of the present disclosure. In the embodiment, as shown in FIG. 9, the display panel includes, sequentially, a substrate 601, an active layer 61, a first metal layer 62, a capacitance metal layer 63, and a second metal layer 64. The display panel further includes an anode 65 on which an organic light-emitting device is disposed. The display panel further includes a gate insulation layer 602 disposed between the active layer 61 and the first metal layer 62, a first interlayer insulation layer 603 disposed between the first metal layer and the capacitance metal layer; a second interlayer insulation layer 604 disposed between the capacitance metal layer and the second metal layer; a planarization layer 605 disposed between the second metal layer and the anode; and a pixel definition layer 606 disposed on the anode. The pixel definition layer includes a plurality of openings in which the material forming the organic light-emitting device is disposed.

In this embodiment, the first clock signal lines 21 are disposed in the second metal layer 64. The fan-out lines include odd-numbered fan-out lines 12*a* and even-numbered fan-out lines 12*b* alternate at an interval. The odd-numbered fan-out lines 12*a* are disposed in the first metal layer 62, and the even-numbered fan-out lines 12*b* are disposed in the capacitance metal layer 63. Due to limitation of the etching process, the minimum distance between two lines in the same metal layer is limited, resulting in a relatively large distance between the fan-out lines, and thus a relatively large occupied area by the fan-out lines, not conducive to reduction of the lower step area. In this embodiment, every two adjacent fan-out lines are respectively disposed in two different metal layers, so that a horizontal distance between two adjacent fan-out lines can be reduced. In this way, the space occupied by the fan-out lines can be reduced. Moreover, a linear distance between two adjacent fan-out lines can be adjusted by adjusting the thickness of the first interlayer insulation layer 603, so that crosstalk caused by excessive capacitance between the two is avoided.

Figure 10:
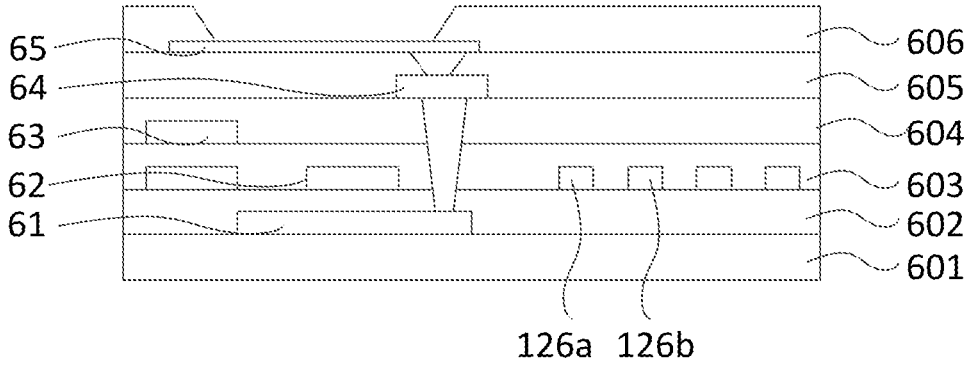
FIG. 10 is a schematic cross-sectional diagram of another display panel according to an embodiment of the present disclosure.

Since the odd-numbered fan-out line 12*a* and the even-numbered fan-out line 12*b* are disposed in different metal layers, the distance between the odd-numbered fan-out line 12*a* and the first clock signal lines 21 is not equal to the distance between the even-numbered fan-out line 12*b* and the first clock signal lines 21. Further referring to FIG. 8 and FIG. 10, where FIG. 10 is a schematic cross-sectional diagram of the display panel according to an embodiment of the present disclosure, each fan-out line includes an overlapping section 126 overlapping the first clock signal lines. The odd-numbered fan-out line 12*a* includes a first odd-numbered overlapping section 126*a* overlapping the first clock signal lines 21. The even-numbered fan-out line 12*b* includes a first even-numbered overlapping section 126*b* overlapping the first clock signal lines 21. The first odd-numbered overlapping section 126*a* and the first even-numbered overlapping section 126*b* are both disposed in the first metal layer 62. In combination with FIG. 8, the section of the fan-out line overlapping the first clock signal lines 21 is the overlapping section 126. In this embodiment, the overlapping sections 126 (including 126*a* and 126*b*) of the odd-numbered fan-out lines 12*a* and the even-numbered fan-out lines 12*b* are all disposed in the same metal layer, so that the odd-numbered fan-out lines 12*a* and the even-numbered fan-out lines 12*b* have an equal vertical distance to the first clock signal lines 21, and further the coupling capacitances are equal, thereby preventing the split screen caused by unequal coupling capacitances. Moreover, the first odd-numbered overlapping portion 126*a* and the first even-numbered overlapping portion 126*b* are both disposed in the first metal layer, and the distance between the first metal layer 62 and the second metal layer 64 is smaller than the distance between the capacitance metal layer 63 and the second metal layer. Therefore, this embodiment can achieve a smaller parasitic capacitance. In this way, coupling has a reduced influence on the data signal, thereby allowing the displaying brightness to be more accurate.

Figure 11:
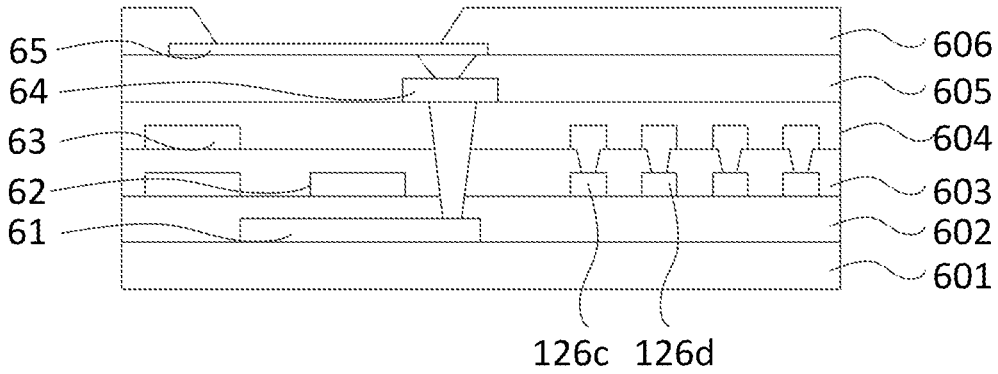
FIG. 11 is a schematic cross-sectional diagram of still another display panel according to an embodiment of the present disclosure.

Further, since the first even-numbered overlapping section 126*b* is disposed in the first metal layer and the remaining section of the even-numbered fan-out line 12*b* is disposed in the capacitance metal layer, and a through hole is needed to connect the two, the process difficulty and the contact resistance are increased. In another embodiment of the present disclosure, referring to FIG. 11, where FIG. 11 is a schematic cross-sectional diagram of still another display panel according to an embodiment of the present disclosure, each odd-numbered fan-out line 12*a* includes a second odd-numbered overlapping section 126*c* overlapping the first clock signal lines, each even-numbered fan-out line 12*b* includes a second even-numbered overlapping section 126*d* overlapping the first clock signal lines 21. The second odd-numbered overlapping portion 126*c* and the second even-numbered overlapping portion 126*d* are both parallel connections of the first metal layer 62 and the second metal layer 63. With the parallel structures, the odd-numbered fan-out line 12*a* and the even-numbered fan-out line 12*b* have an equal vertical distance to the first clock signal lines 211, and the coupling capacitances are equal. In this way, split screen caused by unequal coupling capacitances then can be avoided. Besides, the resistances of the second odd-numbered overlapping section and the second even-numbered overlapping section are reduced.

Figure 14:
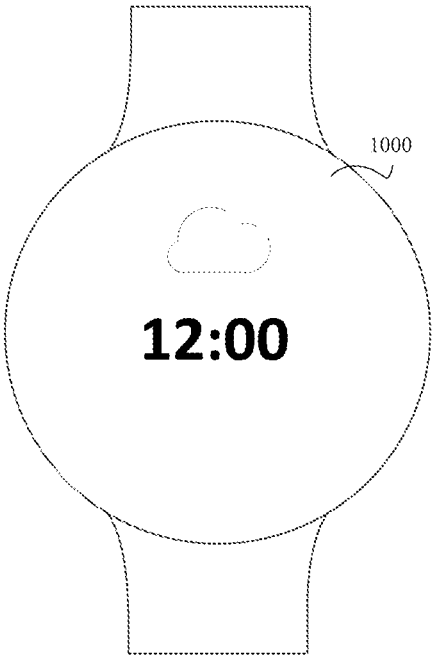
FIG. 14 is a schematic diagram of a display device according to an embodiment of the present disclosure.

The present disclosure also discloses a display device. The display device of the present disclosure includes a display panel as described above. The display panel can be, but not limited to, a watch 1000 as shown in FIG. 14, a cellular mobile phone, a tablet computer, a display of a computer, a display applied to a smart wearable device, or a display device applied to vehicles such as automobiles, etc. As long as the display device includes the display panel disclosed in the present disclosure, it shall fall within the protection scope of the present disclosure.

According to the display panel and the display device provided by the present disclosure, each fan-out line overlaps each first clock signal lines for an equal number of times. In this way, all of the data lines have the same coupling capacitance, thereby avoiding a dark line of a split screen.

The above-described embodiments are merely preferred embodiments of the present disclosure and are not intended to limit the present disclosure. Any modifications, equivalent substitutions and improvements made within the principle of the present disclosure shall fall into the protection scope of the present disclosure.

What is claimed is:

1. A display panel, comprising:

data lines disposed in a display area;

bonding terminals disposed in a non-display area surrounding the display area, the non-display area comprising a first non-display area surrounding the first display area;

fan-out lines;

demuxes disposed between the display area and the bonding terminals, wherein each of the demuxes comprises at least two switch transistors and at least two first clock signal lines, wherein each of the at least two switch transistors in one demux of the demuxes has a first electrode electrically connected to a corresponding data line of the data lines through a first connection line, a second electrode connected to one of the bonding terminals through one of the fan-out lines corresponding to the one demux, and a gate electrode electrically connected to one of the at least two first clock signal lines corresponding to the switch transistor; and scan driving circuits disposed in the first non-display area, wherein each of the scan driving circuits comprises a second clock signal line and an output signal line connected to a scan line disposed in the display area, and the first connection line does not overlap the second clock signal line;

wherein the demuxes are disposed between the scan driving circuits and the display area; a section of one fan-out line of the fan-out lines is located between one of the scan driving circuits and a part of the display panel located in the display area, and each of the output signal lines of the scan driving circuits does not overlap the one fan-out line; and each of the fan-out lines of the display panel overlaps each of the at least two first clock signal lines for an equal number of times;

wherein the display area comprises a first display area in which rows of pixels are disposed, and a number of pixels in each row in the first display area is reduced along a direction toward the bonding terminals;

wherein the display panel further comprises a substrate, an active layer, a first metal layer, a capacitance metal layer and a second metal layer; and wherein the at least two first clock signal lines are disposed in the second metal layer; the fan-out lines comprise odd-numbered fan-out lines and even-numbered fan-out lines alternated at an interval; the odd-numbered fan-out lines are disposed in the first metal layer, and the even-numbered fan-out lines are disposed in the capacitance metal layer.

2. The display panel according to claim 1, wherein the fan-out lines overlap the second clock signal line, and each of the fan-out lines overlaps the second clock signal line for an equal number of times.

3. The display panel according to claim 1, wherein the output signal line overlaps the data lines, but does not overlap the first connection line.

4. The display panel according to claim 1, wherein the at least two first clock signal lines are disposed on a side of the demuxes facing away from the display area, and the at least two first clock signal lines do not overlap the fan-out lines.

5. The display panel according to claim 1, wherein each of the demuxes comprises n switch transistors and n different first clock signal lines; and wherein for one demux of the demuxes, one of the fan-out lines corresponding to the one demux overlaps each of the n different first clock signal lines for an equal number of times.

6. The display panel according to claim 5, wherein one demux of the demuxes comprises six switch transistors and six first clock signal lines, and its corresponding fan-out line overlaps each of the six first clock signal lines once or twice.

7. A display panel, comprising:

data lines disposed in a display area;

bonding terminals disposed in a non-display area surrounding the display area, the non-display area comprising a first non-display area surrounding the first display area;

fan-out lines;

demuxes disposed between the display area and the bonding terminals, wherein each of the demuxes comprises at least two switch transistors and at least two first clock signal lines, wherein each of the at least two switch transistors in one demux of the demuxes has a first electrode electrically connected to a corresponding data line of the data lines through a first connection line, a second electrode connected to one of the bonding terminals through one of the fan-out lines corresponding to the one demux, and a gate electrode electrically connected to one of the at least two first clock signal lines corresponding to the switch transistor;

scan driving circuits disposed in the first non-display area, wherein each of the scan driving circuits comprises a second clock signal line and an output signal line connected to a scan line disposed in the display area, and the first connection line does not overlap the second clock signal line; and a first clock signal line bonding terminal;

wherein the demuxes are disposed between the scan driving circuits and the display area, a section of one fan-out line of the fan-out lines is located between one of the scan driving circuits and a part of the display panel located in the display area, and each of the output signal lines of the scan driving circuits does not overlap the one fan-out line; and each of the fan-out lines of the display panel overlaps each of the at least two first clock signal lines for an equal number of times;

wherein the display area comprises a first display area in which rows of pixels are disposed, and a number of pixels in each row in the first display area is reduced along a direction toward the bonding terminals;

wherein the bonding terminals comprise a first bonding terminal and a second bonding terminal, and the first clock signal bonding terminal is disposed between the first bonding terminal and the second bonding terminal;

the fan-out lines comprise a first fan-out line and a second fan-out line, wherein the first fan-out line is connected to the first bonding terminal, and the second fan-out line is connected to the second bonding terminal; and the at least two first clock signal lines are connected to the first clock signal line bonding terminal through a second connection line, wherein the second connection line is disposed between the first fan-out line and the second fan-out line, and the second connection line does not overlap any of the first fan-out line or the second fan-out line.

8. The display panel according to claim 7, wherein a connection point at which the first fan-out line is connected to its corresponding demux is disposed on a side of the demux facing away from the second fan-out line; and a connection point at which the second fan-out line is connected to its corresponding demux is disposed on a side of the demux facing away from the first fan-out line.

9. The display panel according to claim 8, further comprising first electrostatic discharge circuits and third connection lines, wherein the first electrostatic discharge circuits are connected to the at least two first clock signal lines through the third connection lines, and are configured to discharge static electricity of the at least two first clock signal lines;

at least a portion of the first electrostatic discharge circuits is disposed between the first fan-out line and the second fan-out line.

10. The display panel according to claim 9, wherein the third connection lines do not overlap the fan-out lines.

11. The display panel according to claim 9, wherein the fan-out lines comprise at least one third fan-out line which overlaps one of the third connection lines for one time and a fourth fan-out line which does not overlap the third connection lines;

the fourth fan-out line comprises a first overlapping section which overlaps each of the at least two first clock signal lines for one time.

12. The display panel according to claim 11, wherein the third connection lines comprise a first type of third connection line and a second type of third connection line, the at least one third fan-out line overlaps the first type of third connection line, but does not overlap the second type of third connection line;

each of the at least one third fan-out line comprises a second overlapping section, and the second overlapping section overlaps a first clock signal line corresponding to the second type of third connection line for one time.

13. The display panel according to claim 1, wherein each of the odd-numbered fan-out lines comprises a first odd-numbered overlapping section which overlaps the at least two first clock signal lines, each of the even-numbered fan-out lines comprises a first even-numbered overlapping section which overlaps the at least two first clock signal lines;

the first odd-numbered overlapping section and the first even-numbered overlapping section are both disposed in the first metal layer.

14. The display panel according to claim 1, wherein each of the odd-numbered fan-out lines comprises a second odd-numbered overlapping section which overlaps the at least two first clock signal lines, and each of the even-numbered fan-out lines comprises a second even-numbered overlapping section which overlaps the at least two first clock signal lines;

the second odd-numbered overlapping section and the second even-numbered overlapping section are both parallel connections of the first metal layer and the second metal layer.

15. The display panel according to claim 1, wherein each of the demuxes is connected to the at least two first clock signal lines through respective fourth connection lines, and fourth connection lines corresponding to each demux constitute an isosceles triangle.

16. The display panel according to claim 1, further comprising pixel driving circuits, wherein each of the scan driving circuits is configured to generate a scan signal which enables a data signal configured for writing into one of the pixel driving circuits, and each of the pixel driving circuits is configured to generate a driving current for the rows of pixels; and in one cycle, an effective level of the scan signal is after an effective level of the first clock signals.

17. A display device comprising a display panel, wherein the display panel comprises:

data lines disposed in a display area;

bonding terminals disposed in a non-display area surrounding the display area, the non-display area comprising a first non-display area surrounding the first display area;

fan-out lines;

demuxes disposed between the display area and the bonding terminals, wherein each of the demuxes comprises at least two switch transistors and at least two first clock signal lines wherein each of the at least two switch transistor in one demux of the demuxes has a first electrode electrically connected to a corresponding data line of the data lines through a first connection line, a second electrode connected to one of the bonding terminals through one of the fan-out lines corresponding to the one demux, and a gate electrode electrically connected to one of the at least two first clock signal lines corresponding to the switch transistor; and scan driving circuits disposed in the first non-display area, wherein each of the scan driving circuits comprises a second clock signal line and an output signal line connected to a scan line disposed in the display area, and the first connection line does not overlap the second clock signal line;

wherein the demuxes are disposed between the scan driving circuits and the display area; a section of one fan-out line of the fan-out lines is located between one of the scan driving circuits and a part of the display panel located in the display area, and each of the output signal lines of the scan driving circuits does not overlap the one fan-out line; and each of the fan-out lines of the display panel overlaps each of the at least two first clock signal lines for an equal number of times;

wherein the display area comprises a first display area in which rows of pixels are disposed, and a number of pixels in each row in the first display area is reduced along a direction toward the bonding terminals;

wherein the display panel further comprises a substrate, an active layer, a first metal layer, a capacitance metal layer and a second metal layer; and wherein the at least two first clock signal lines are disposed in the second metal layer; the fan-out lines comprise odd-numbered fan-out lines and even-numbered fan-out lines alternated at an interval; the odd-numbered fan-out lines are disposed in the first metal layer, and the even-numbered fan-out lines are disposed in the capacitance metal layer.

* * * * *